United States Patent [19]

Arikawa

[11] 4,293,836

[45] Oct. 6, 1981

[54] ELECTRICAL FUSE WITH AN IMPROVED FUSIBLE ELEMENT

[75] Inventor: Hiroo Arikawa, Tokyo, Japan

[73] Assignee: San-O Industrial Co., Ltd., Tokyo, Japan

[21] Appl. No.: 56,533

[22] Filed: Jul. 11, 1979

[51] Int. Cl.[3] ..... H01H 85/04

[52] U.S. Cl. ..... 337/290; 337/297

[58] Field of Search ..... 337/290, 292, 295, 296, 337/297

[56] References Cited

U.S. PATENT DOCUMENTS

| | | | |
|---|---|---|---|
| 3,267,238 | 8/1966 | Arikawa | 337/296 X |
| 3,845,439 | 10/1974 | Deelman | 337/295 X |
| 4,122,426 | 10/1978 | Maruo | 337/297 X |
| 4,177,444 | 12/1979 | Taki | 337/290 X |

*Primary Examiner*—George Harris

[57] ABSTRACT

An improved fuse is provided for protection of electrical appliances with low rated current capacities in which the fusible element is made of a monofilament of quartz glass fiber coated with an alloy composed of silver, copper, tin and antimony.

2 Claims, 4 Drawing Figures

ELECTRICAL FUSE WITH AN IMPROVED FUSIBLE ELEMENT

BACKGROUND OF THE INVENTION

1. Field of Invention

This invention relates to electrical fuses and is particularly related to an electrical fuse having an improved fusible element which is useful for the protection of electrical appliances with low rated current capacity.

2. The Prior Art

Electrical fuses having low rated current capacity are well known and have been widely used for protection of electrical appliances. Fuses having low rated current capacity of the order of 100 m A or less usually require a fusible element, preferably made of silver wire having a diameter of the order of 10 μm or less. However, silver wires with such extremely small diameter are difficult to fabricate and, in addition, they lack the requisite mechanical strength and structural integrity. As a practical matter, it is difficult to fabricate silver wires having a diameter smaller than about 45 μm.

In order to overcome the aforementioned difficulties and permit the use of fusible elements made of silver wire with the desired small diameters, it has been suggested to use, as the fusible element, a monofilament yarn made of a plastic material such as polyacrylonitrile wherein the surface of the filament is either chemically coated or it is electroplated after chemical coating in order to make an electrically conductive filament for use as a fusible element. One of the drawbacks of these fusible elements is the relatively low melting point of the coating on the yarn surface which is necessarily limited by the softening point of the coated polyacrylonitrile filament yarn, i.e., 125° C., or less.

Another type of fuse suggested in the prior art employs an insulated film of a high molecular plastic material as a supporting member, the surface of which is coated with a suitable metal to make the fusible element. The problem with this type of fusible element is that the high molecular weight plastic support member is heat sensitive and is readily deformed by the thermal expansion caused by excessive current flow. Moreover, excessive current flow through the metal coating causes it to crack, and therefore, current flow may be prematurely interrupted. Also, repeated rise and fall in temperature during the current flow adversely affects the physical properties of the plastic support material and could result in its permanent and irreversible deformation, with consequent instability of the fuse.

Accordingly, it is an object of the present invention to provide an improved fuse for use in electrical appliances having low rated current capacity.

It is another object of this invention to provide an improved fuse having a novel and unique fusible element which exhibits excellent performance and improved fusing characteristics when used in electrical appliances having low rated current capacities as low as about 1 milliampere and as high as about 250 milliamperes.

It is still another object of this invention to provide such fuses which are more stable and more durable than comparable prior art fuses.

The foregoing and other objects of this invention will become more apparent from the following detailed description thereof taken in conjunction with the accompanying drawings.

SUMMARY OF THE INVENTION

The invention contemplates providing a fuse of the usual type and variety which, as is well known, generally comprises a fuse cartridge capped at both ends with electrically conductive terminals and wherein the fusible element is stretched in said cartridge between said conductive terminals in electrical contacts therewith. The fusible element itself, which constitutes the novel and unique feature of this invention, comprises a supporting member which is a monofilament made of quartz glass fiber, the exterior surface of which is coated with an electrically conductive alloy composed of silver, copper, tin and antimony.

DESCRIPTION OF THE DRAWINGS

In the drawings which serve to illustrate the advantages of the present invention.

DETAILED DESCRIPTION OF THE INVENTION

In accordance with this invention, a unique fusible element is provided which can be incorporated into any conventional fuse. The fuse, as in other familiar fuse constructions, comprises an insulated tube or cartridge which is capped at both ends with electrically conductive terminals (e.g., ferrules), and a fusible element stretched between said two terminals in electrical contact therewith, such as by solder (not specifically shown).

Figure 4:
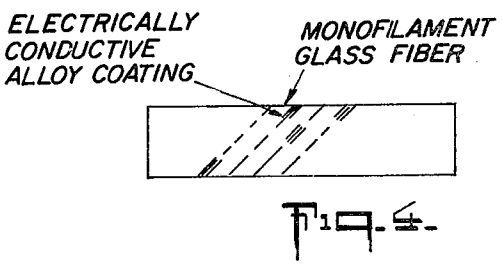
FIG. 4 illustrates a fuse formed from a monofilament of quart glass coated with electrically conductive alloy.

The uniqueness of the invention resides in the fusible element itself which consists of a support member made of a monofilament yarn of quartz glass fiber, the exterior surface of which is coated with a uniform layer of an alloy composed of silver (Ag), copper (Cu), tin (Sn) an antimony (Sb), thereby providing an electrically conductive fusible element, generally shown in FIG. 4.

While the composition of the alloy may vary somewhat and still retain the beneficial results intended herein, suitable alloys are those which consist of from about 71 to about 73 weight percent silver, from about 22 to about 24 weight percent copper, from about 2 to about 4 weight percent tin and from about 1 to about 3 weight percent antimony. Obviously, the exact compositions are selected to make up 100 weight percent silver alloy.

An alloy of silver, copper, tin and antimony, having the aforementioned composition, provides an excellent coating for the monofilament and imparts good electrical conductivity and other desirable properties thereto.

Another unique feature of this invention resides in the inclusion of antimony in the alloy coating composition. The advantages of including antimony will become more apparent from the ensuing description and the accompanying graphs.

One of the advantages of the fusible element of this invention is its thermal stability which permits its repeated use over many years. This is because the alloy coating has a very high melting point (872° C. and a very high recrystallization temperature (245° C.). These temperatures are considerably higher than the melting point and crystallization temperature of low melting point metals which are usually about 150° C. and 20° C., or less, respectively. Thus, with the ordinary metal, the low crystallization temperature results in adverse recrystallization effects even at ambient temperatures which, in turn, adversely affect the physical properties of the coating and hence result in undesirable changes in the fusing characteristics of the fusible element.

Since the ambient temperature effects, more or less, the physical property of the metal used in making the fusible element, it is preferable to employ, for this purpose, metals which are less affected by ambient temperatures and have high melting temperatures. A metal with higher melting point has a more stable performance as a fuse because such metals have, roughly in proportion to their melting points, higher crystallization temperatures at which the physical property of the metal begins to change, and further, because such crystallization temperatures are well above the ambient temperature. It has been found that silver or silver alloys is the most preferred metal for making the fusible element since they have a high melting point and are not affected by the environment. They also have other well known excellent characteristics.

The fusible element of this invention, with its unique alloy coating and high melting point and recrystallization temperature, is more stable and shows no adverse effects on physical properties of the fuse even when used at temperatures considerably above ambient temperature, over a long period of time.

Another advantage of this invention is its increased stability for short term use resulting from the addition of about 2 percent by weight of antimony to the silver alloy.

A further advantage of this invention is due to the use of monofilament yarn of glass quartz fiber as the support for the alloy coating. Glass quartz fiber is highly resistant to heat flow and exhibits excellent durability over repeated use at temperatures as high as 1000° C., which is higher than the melting point of the silver alloy coating. Quartz glass is durable even over consecutive uses at temperatures as high as 1000° C., maintaining a considerably high viscosity of $4.5\times10^7$ poise even at a temperature of 1500° C. Therefore, unlike metal-coated high molecular weight plastic support members in which the melting point of the support member is usually lower than the melting point of the metal coating, in the fusible element of this invention the the melting point of the silver alloy coating is unaffected by the melting point of the support member.

Still another advantageous feature of the fusible element of this invention lies in its accuracy and highly improved fusing characteristic, as shown in the following table, which shows the thermal expansion for quartz glass fiber at different temperature ranges.

| Temperature Range, °C. | Thermal Coefficient $\times 10^{-7}$ deg.$^{-1}$ |
|---|---|
| 0–30 | 4.2 |

-continued

| Temperature Range, °C. | Thermal Coefficient $\times 10^{-7}$ deg.$^{-1}$ |
|---|---|
| 30–100 | 5.3 |
| 100–500 | 5.8 |
| 500–900 | 5.0 |

The small thermal coefficient of quartz glass fiber is in contrast to the higher thermal coefficient for plastic materials ($5\text{–}2\times10^{-5}$ deg. $^{-1}$) and metal ($4\text{–}60\times10^{-6}$ deg. $^{-1}$). Thus, the so-called "Joules" heat effect presents less thermal problems in quartz glass fiber than in plastics or metals.

Figure 3:
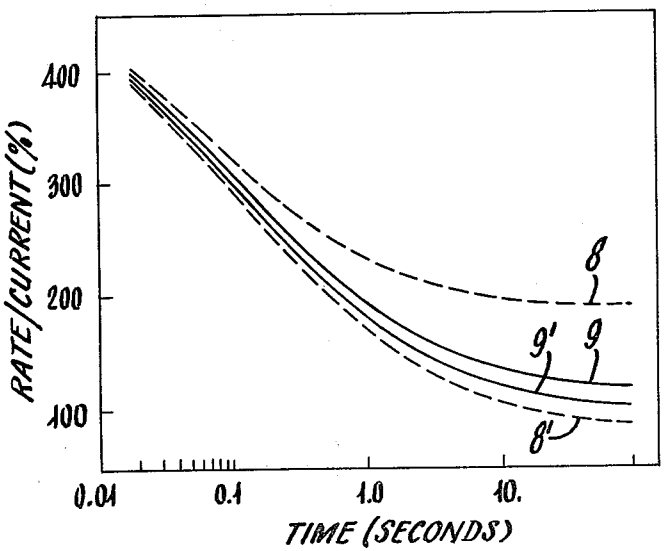
FIG. 3 is still another graphical representation comparing the fusing characteristics of a fusible element made in accordance with the present invention with a typical prior art fuse.

The advantages of the present invention will now be further illustrated by reference to the graphs shown in FIG. 1–3.

Figure 1:
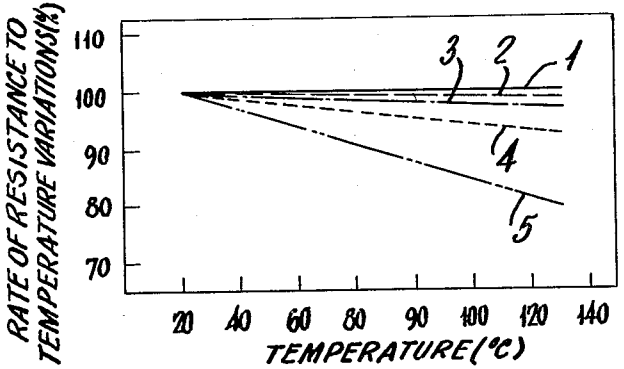
FIG. 1 consists of a series of graphs which illustrates the variations in temperature resistance of fuses employing the fusible element of this invention, and in particular, it illustrates the advantages of including antimony in the alloy coating.

Thus, in FIG. 1, where the rate of resistance to temperature variations is plotted as ordinate against temperature (abscissa), curves 1, 2, 3 4 and 5 represent the resistance to temperature variations of identical fusible elements but for the amount of antimony which is added to the silver alloy coating. The amounts of antimony in the silver alloy coatings corresponding to said curves are 1, 2, 3, 5 and 0 weight percents, respectively.

As shown in FIG. 1, curves 1, 2 and 3 show less temperature variations, and hence greater stability, than curves 4 and 5, indicating that the performance of the fusible element is best when the amount of antimony in the silver alloy coating is from about 1 to about 3 weight percent. In this range, the resistance-temperature coefficient will remain within a very narrow range at temperatures up to 150° C. Higher amounts of antimony result in greater temperature variations. Moveover, even greater temperature variations (and hence more instability) results when no antimony is used in the silver alloy coating, thus indicating the significance of including antimony, in the desired amounts, in the silver alloy coating.

Figure 2:
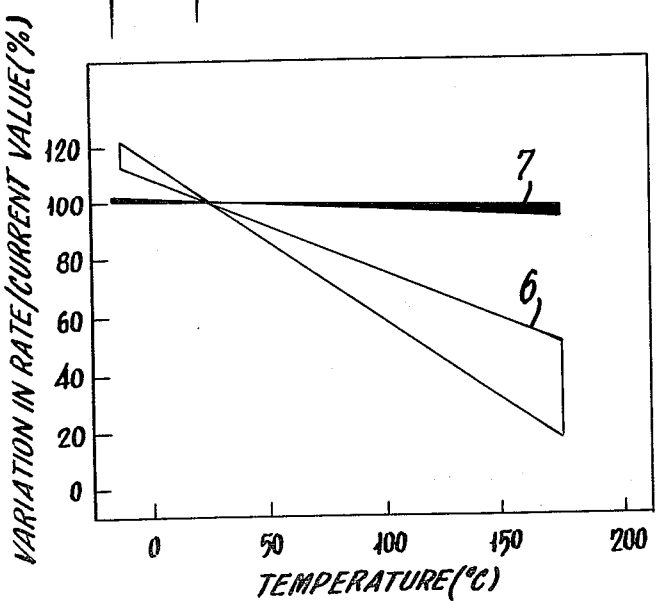
FIG. 2 consists of two graphs which compare the temperature characteristics of two fuses; one made in accordance with the present invention, and the other made as in the prior art.

Referring to FIG. 2, where the variation in rated current value is plotted against ambient temperature, graph 6 represents the temperature characteristic of a fusible element made in accordance with the prior art wherein a plastic support material is coated with a metal, and graph 7 represents the temperature characteristic of a fusible element made according to the present invention, wherein silver alloy was coated on a monofilament of glass quartz fiber.

A rated current value of 63 mA was obtained by using a fusible element with a silver alloy coating which had a thickness of 1 μm and the quartz glass support member had a diameter of 80 μm.

As indicated in FIG. 2, at 150° C. ambient temperature, the prior art fuse is subjected to considerably greater variation in rated current value (70°%) as compared to the fusible element of this invention whose rated current value varies only by about 5%.

Finally, and with reference to FIG. 3, where percent rated current is plotted against fusing time, graphs 8,8 represents the fusing characteristic of a prior art fusible element (as described in connection with FIG. 2) and graphs 9,9 represent fusing characteristic of a fusible element of this invention (also as described in connection with FIG. 2). Comparison of these graphs show less dispersion when using a fusible element made in accordance with the present invention as compared to the prior art type fusible element.

Thus, from the foregoing description and the drawings, it is evident that an improved fusible element is provided which may be incorporated in ordinary fuses to impart thereto excellent temperature behavior, greater thermal stability and durability over a long period of use, and highly improved fusing characteristic.

While the present invention has heretofore been described in detail, and with a certain degree of specificity, it is obvious that numerous changes and modifications may be made therein which are contemplated and suggested by this disclosure, and which are therefore encompassed within the scope of this invention.

What is claimed is:

1. A fusible element for use in electrical fuses, said fusible element consisting of a support member made from a monofilament yarn of glass quartz fiber and a metallic alloy coating on the exterior surface of said support member, said metallic alloy consisting essentially of silver, copper, tin and antimony.

2. A fusible element as in claim 1 wherein said metallic alloy coating consists of from about 71 to about 73 weight percent silver, from about 22 to about 24 weight percent copper, from about 2 to about 4 weight percent tin and from about 1 to about 3 weight percent antimony.

* * * * *